US006889981B2

(12) United States Patent
Parker

(10) Patent No.: US 6,889,981 B2
(45) Date of Patent: May 10, 2005

(54) CARD GAMES INVOLVING INCREASED POSSIBLE COMBINATIONS OF CARDS

(75) Inventor: Alan Geoffrey Parker, South Glamorgan (GB)

(73) Assignee: Gamesoft Limited, Cardiff (DE)

( * ) Notice: Subject to any disclaimer, the term of this patent is extended or adjusted under 35 U.S.C. 154(b) by 0 days.

(21) Appl. No.: 10/367,727

(22) Filed: Feb. 19, 2003

(65) Prior Publication Data

US 2003/0155716 A1 Aug. 21, 2003

(30) Foreign Application Priority Data

Feb. 19, 2002 (GB) ..... 0203870

(51) Int. Cl.[7] ..... A63F 1/00

(52) U.S. Cl. ..... 273/292; 273/274; 273/309; 463/13

(58) Field of Search ..... 273/292, 274, 273/309; 463/13

(56) References Cited

U.S. PATENT DOCUMENTS 4,662,637 A * 5/1987 Pfeiffer ..... 273/149 P
4,926,327 A * 5/1990 Sidley ..... 463/13
5,037,108 A * 8/1991 Banasky ..... 273/242
5,076,588 A * 12/1991 Minh ..... 273/292
5,125,660 A * 6/1992 Stahl ..... 273/146
5,423,551 A * 6/1995 Stavinsky ..... 273/306
5,431,408 A * 7/1995 Adams ..... 273/306
5,489,101 A * 2/1996 Moody ..... 273/292
5,657,992 A * 8/1997 Bellizzi ..... 273/273
5,775,992 A * 7/1998 Wood et al. ..... 463/13
5,785,593 A * 7/1998 Wood et al. ..... 463/13
6,045,129 A * 4/2000 Cooper et al. ..... 273/292
6,120,031 A * 9/2000 Adams ..... 273/292
6,135,882 A * 10/2000 Kadlic ..... 463/13
6,146,271 A * 11/2000 Kadlic ..... 463/13
6,174,235 B1 * 1/2001 Walker et al. ..... 463/25
6,206,373 B1 * 3/2001 Garrod ..... 273/292
6,234,481 B1 * 5/2001 Robertson ..... 273/243
6,299,170 B1 * 10/2001 Yoseloff ..... 273/292
6,322,078 B1 * 11/2001 Adams ..... 273/292
6,336,857 B1 * 1/2002 McBride ..... 463/12
6,358,144 B1 * 3/2002 Kadlic et al. ..... 463/13
6,403,908 B2 * 6/2002 Stardust et al. ..... 209/587
6,419,578 B1 * 7/2002 Moody et al. ..... 463/13
6,435,509 B2 * 8/2002 Wichinsky et al. ..... 273/292
6,467,771 B1 * 10/2002 deKeller ..... 273/274
6,474,649 B1 * 11/2002 Kennedy et al. ..... 273/304
6,494,454 B2 * 12/2002 Adams ..... 273/292
6,511,068 B1 * 1/2003 Sklansky et al. ..... 273/237
6,533,658 B1 * 3/2003 Walker et al. ..... 463/13
6,561,902 B1 * 5/2003 Walker et al. ..... 463/25
6,565,432 B2 * 5/2003 Moody ..... 463/13
6,568,680 B1 * 5/2003 Moody et al. ..... 273/292
6,616,142 B2 * 9/2003 Adams ..... 273/292
6,637,747 B1 * 10/2003 Garrod ..... 273/292
2002/0034974 A1 * 3/2002 Wood et al. ..... 463/13
2002/0037762 A1 * 3/2002 Wood et al. ..... 463/13
2002/0058542 A1 * 5/2002 Roethel et al. ..... 463/13
2002/0145255 A1 * 10/2002 Rudolph ..... 273/292
2002/0155871 A1 * 10/2002 Celona et al. ..... 463/13
2003/0032469 A1 * 2/2003 Moody et al. ..... 463/13
2003/0047875 A1 * 3/2003 Adams ..... 273/292
2003/0069055 A1 * 4/2003 Moody ..... 463/13
2003/0164590 A1 * 9/2003 Moody ..... 273/292
2003/0189290 A1 * 10/2003 Moody ..... 273/292
2003/0214097 A1 * 11/2003 Moody ..... 273/292

OTHER PUBLICATIONS

Walter B. Gibson—Hoyle's Modern Encyclopedia of Card Games—Doubleday–1974– p. 239.*

* cited by examiner

*Primary Examiner*—Raeann Gorden
*Assistant Examiner*—Dolores Collins
(74) *Attorney, Agent, or Firm*—Young & Thompson

(57) ABSTRACT

A method of playing a card game including steps of selecting a combination of cards in an at least apparently random manner, the combination including zero or more special cards (not a conventional wild card such as a joker), and determining whether the combination results in a win or lose state.

13 Claims, 3 Drawing Sheets

| Coins | 1 | 2 | 3 | 4 | 5 |
|---|---|---|---|---|---|
| Five Double Diamond | 500 | 1000 | 1500 | 2000 | Progressive Jackpot 113 |
| Four Double Diamond plus any | 250 | 500 | 750 | 1000 | 1250 |
| Four of a Kind plus Double Diamond | 150 | 300 | 450 | 600 | 750 |
| Royal Flush | 100 | 200 | 300 | 400 | 500 |
| Straight Flush | 50 | 100 | 150 | 200 | 250 |
| Four of a Kind | 20 | 40 | 60 | 80 | 100 |
| Full House | 6 | 12 | 18 | 24 | 30 |
| Flush | 5 | 10 | 15 | 20 | 25 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

*Fig. 3*

CARD GAMES INVOLVING INCREASED POSSIBLE COMBINATIONS OF CARDS

The present application claims priority of GB 0203870.1 filed Feb. 19, 2002.

FIELD OF THE INVENTION

The present invention relates to card games.

BACKGROUND TO THE INVENTION

Video card games, in particular Video Poker, have been popular for many years. However, due to the limited number of cards in a standard deck the possible combinations restrict large jackpot payouts.

Most Video Poker games pay the largest jackpot prize for a Royal Flush (Ace, King, Queen, Jack, Ten of same suit). Whilst the chances of receiving this hand on an initial deal is very low (1 in 649,740 games) there are usually many other combinations that pay a prize. If some of these other paying combinations are removed to increase the jackpot prize whilst still ensuring that the machine does not make a loss, the game loses popularity with players as prizes are paid out less frequently.

Non-standard decks of cards have been used in Video Poker games previously, e.g. in the game known as "Jokers Wild" where a Joker is added to the deck and is used as a "wild" symbol that can represent any other card. This only compounds the problem of paying large prizes as there is a 1 in 53 chance of a Joker being dealt on the initial deal each game and this significantly increases the chance of a payment being made to a player.

SUMMARY OF THE INVENTION

Embodiments of the present invention can increase the number of possible combinations of cards that can be dealt to a player so that very large jackpot payouts are possible, without the need to significantly reduce the frequency of wins.

According to a first aspect of the present invention there is provided a method of playing a card game including steps of:

selecting a combination of cards in an at least apparently random manner, the combination including zero or more special cards, and determining whether the combination results in a win or lose state.

The step of selecting a combination of cards may include steps of:

selecting a deck of cards from a plurality of decks in an at least apparently random manner, and selecting a combination of cards from the selected deck in an at least apparently random manner, wherein each said deck in the plurality of decks includes a plurality of conventional playing cards or a plurality of conventional playing cards and one or more special cards.

In this specification a "special card" is distinguished from a conventional "wild card" such as a Joker. For example, a special card can be a duplicate of any conventional card in the game, e.g. if it is additional to a conventional 52 card pack then it can be a duplicate of one of those 52 cards. Each deck can include virtually any number of cards, typically fifty-two cards, although fewer cards may be included in at least some of the decks. The majority of the decks, e.g. 90% to 99%, may be substantially conventional decks of 52 conventional playing cards, with a smaller number of decks including at least one special card. The decks including special cards may include fifty-two conventional playing cards plus one or more special cards, or all the decks may have the same number of cards with the special decks having at least one card differentiated from a conventional card. Such a special card could be a conventional card "missing" from the deck that is superimposed with some device to make it readily distinguishable.

The special card may be a prize-awarding special card, whose presence in the combination can result in an additional award being made to the player. The additional award (e.g. the number of points being doubled or a particular number of points) may be given when a combination that results in a win state (for all or just specific winning combinations) includes one or more special card. Alternatively or additionally, an award may be paid out when a combination simply includes one or more special prize-awarding cards.

At least some of the cards making up the combination may be predetermined (e.g. stored data representing the cards in a deck is retrieved). Alternatively or additionally, at least some of the cards in the combination may be selected in an at least apparently random manner.

In one embodiment, there are one hundred decks of cards, six of which include special cards.

The step of selecting the combination may include selecting cards in accordance with a probability factor. For example, the probability of the combination including one special card may be set at 5%. The probability factor of a said special card being selected for inclusion in the combination may vary in accordance with an amount bet by a player. Typically the probability of a special card being selected increases if the player places a higher bet.

The game may be a Poker game, with the symbols being those of playing cards and each combination being a Poker hand. In this case, the step of determining whether a combination of cards results in a win state or a lose state may be made in accordance with substantially conventional Poker rules. It will be appreciated that the principle can also be used in card games other than Poker.

At least some of the cards in the combination may be presented face-down. The method may further include a step of using at least some of the cards of the combination (e.g. ones that have been presented/turned face-up) as part (at least) of one or more further combinations of cards. The other cards in the further combination(s) may be selected from the selected deck or from one or more of the other decks.

According to a further aspect of the present invention there is provided a method of playing a card game including steps of:

selecting one deck of cards from a plurality of decks in an at least apparently random manner;

selecting a combination of cards from the selected deck in an at least apparently random manner, and determining whether the combination results in a win or lose state, wherein some of the decks contain a standard number of cards and the remaining decks contain a different number of cards.

The standard number of cards is typically 52. At least some of the remaining decks can include fewer cards or more cards than the standard decks. For example, 10 out of a total of 100 decks may contain fewer than 52 cards. This has a similar effect to where some of the decks contain wild cards, that is, the chances of a player being dealt a winning hand is decreased.

According to yet another aspect of the present invention there is provided a method of playing a card game including steps of:

generating a deck of cards in an at least apparently random manner, the deck including zero or more special cards;

selecting a combination of cards from the deck, and determining whether the combination results in a win state or a lose state.

The step of generating the deck of cards may involve selecting a subset of cards from a plurality of cards. The number of cards from which a subset is selected may be equal to the number of cards comprising at least two standard decks of cards.

The generated deck may include a plurality of conventional playing cards and zero or more special cards.

The apparently random generation of the deck may be weighted so that certain cards are less likely to be included in the deck than others.

The method may further include a step of checking if the selected combination of cards includes any identical cards. If this is the case then at least one of the identical cards may be replaced by another card selected in an at least apparently random manner from the deck.

According to a further aspect of the present invention there is provided an amusement or gaming apparatus configured to execute the steps of a method substantially as described above. Several such apparatus may be linked to communicate with each other.

Whilst the invention has been described above, it extends to any inventive combination of the features set out above or in the following description.

BRIEF DESCRIPTION OF THE DRAWINGS

The invention may be performed in various ways, and, by way of example only, an embodiment thereof will now be described, reference being made to the accompanying drawings, in which:

FIG. 3 shows the pay out schedule in more detail.

DETAILED DESCRIPTION OF THE DRAWINGS

Figure 1:
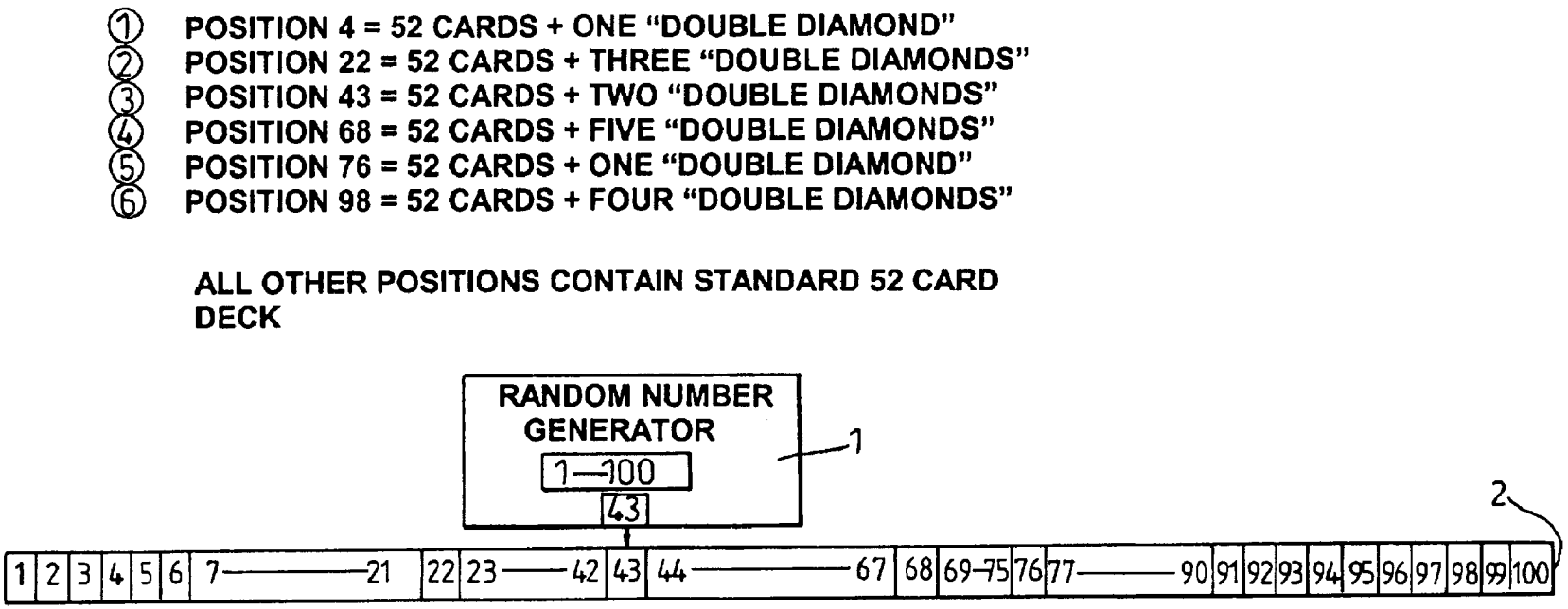
FIG. 1 illustrates schematically a deck selection component of a gaming machine according to a preferred embodiment.

FIG. 1 shows schematically an electronic random number generator 1 that can select a number between 1 and 100 in a substantially random manner. Data describing one hundred decks of cards is stored in an array 2, the decks being labelled 1 to 100. In the example, decks containing at least one special card are distributed in array positions 4, 22, 43, 68, 76 and 98 as follows:

Deck 4 contains 52 standard cards plus one special "double diamond" card.

Deck 22 contains 52 standard cards plus three special "double diamond" cards.

Deck 43 contains 52 standard cards plus two special "double diamond" cards.

Deck 68 contains 52 standard cards plus five special "double diamond" cards.

Deck 76 contains 52 standard cards plus one special "double diamond" card.

Deck 98 contains 52 standard cards plus four special "double diamond" cards.

Standard fifty-two playing card decks not containing any special cards are stored in the 94 other array positions.

In the example, the random number generator has selected deck 43 for use in the game.

It will be apparent to those skilled in the art that the cards making up the decks can be determined by retrieving stored data. Alternatively, at least some of the decks can be substantially randomly generated at certain intervals, for example each time the machine is switched on or when a player runs out of credit.

In a further alternative embodiment, rather than having separate decks, a number of cards that would constitute a plurality of decks are effectively all "shuffled" together and a hand of cards is selected from the result. In yet another alternative embodiment, the random number generator can be used to select from an array where each location in the array stores a single card rather than a deck of cards. The cards in the array may be stored in order by face value and/or by suit or the array location of each card can be determined in a random manner. Such an array is of a size suitable for storing a number of cards that would constitute several decks. Identical cards that are selected for inclusion in a hand may be replaced by selecting another card in a substantially random manner.

It will also be appreciated that it may not be necessary to store and manipulate data representing multiple decks of cards. For example, an at least apparently random number generator can be used to produce a number representing the face value of a card (e.g. 1=1, 10=Jack, 11=Queen, etc) and a code representing the suit (e.g. 1=hearts, 2=diamonds, 5=special card, etc.). The number generator can be implemented so that the probability of it selecting a hand of five cards in this way is substantially identical to the probability of selecting the same hand using a certain number of physical decks of cards. Thus, it can simulate the random selection of a deck and choosing a hand of cards from that deck.

Figure 2:
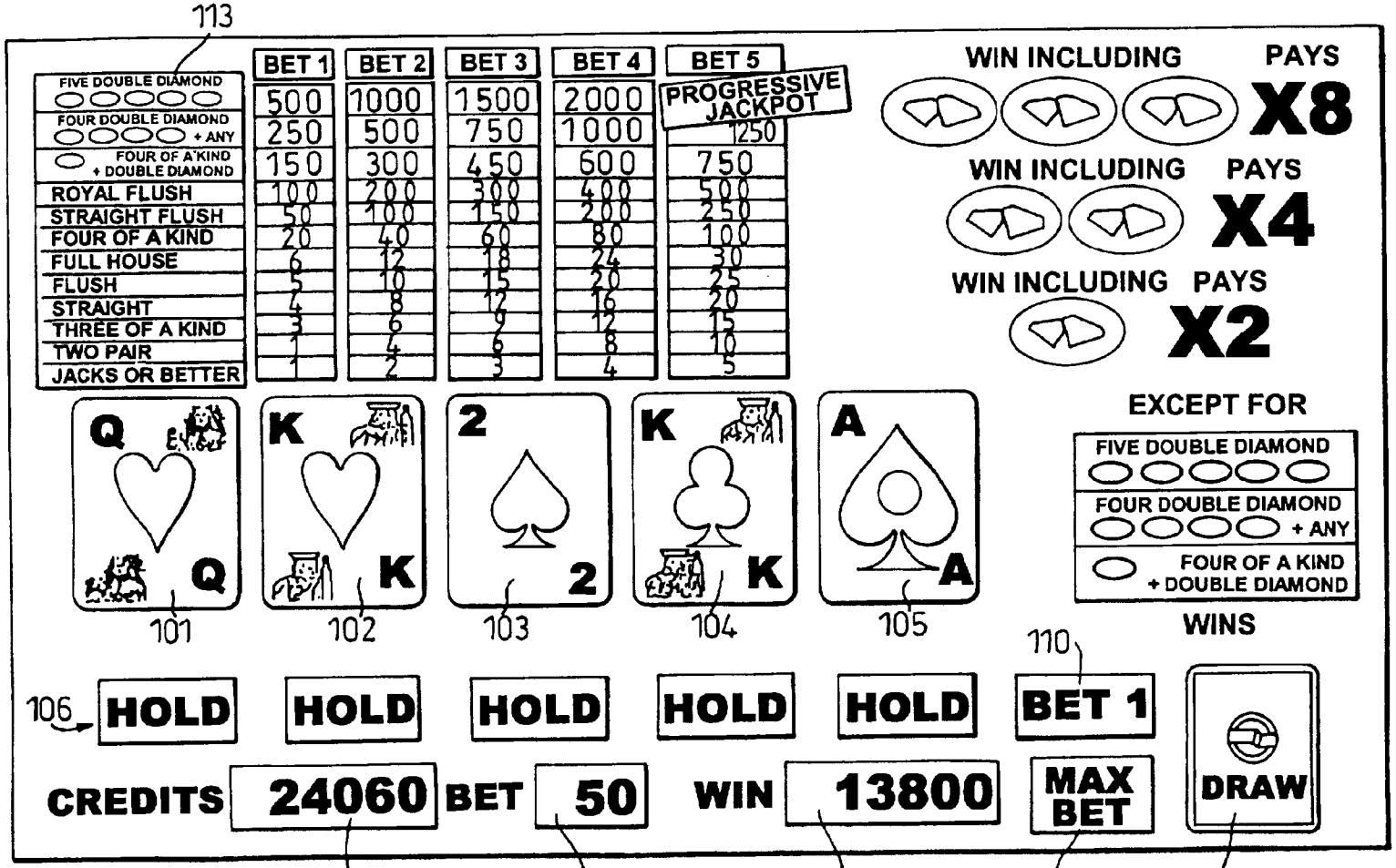
FIG. 2 illustrates a screen display produced by the gaming machine, including a pay out schedule.

Returning to the example, five cards constituting a poker hand are substantially randomly selected from the deck 43. These are presented to the player at locations 101 to 105 of the screen display of FIG. 2. The display also contains several elements that are common to existing Video Poker games, such as five touch screen Hold buttons 106, each corresponding to one of the cards 101 to 105. Credits (the total credits playable) 107, Bet (the number of credits staked on the current hand) 108 and Win (the total points scored by the player) 109 displays are also included. Further touch screen buttons include a Bet 1 (i.e. increase number of credits staked on the current hand by one) button 110, a Max Bet (i.e. stake 5 credits) button 111 and a Draw button 112. Operation of these elements is well known to those skilled in the art.

The display further includes a pay table 113 which shows the amount of points awarded if a winning poker hand is dealt, the amount varying with the number of credits bet by the player, as shown in the columns Bet 1 to Bet 5. For example, if the player has bet three credits and is dealt a Four of a Kind hand then the number of points awarded is 60.

FIG. 3 shows the pay schedule 113 in more detail. Five Double Diamond symbols pay a progressive jackpot when a maximum bet of five coins is played. Due to the low probability of achieving this combination the jackpot may well be set at levels above one million dollars, particularly if a plurality of machines are linked together with stakes from each machine contributing to increase the jackpot level. Techniques for achieving this are known to the skilled person.

If the jackpot is paid on achieving five double-diamond cards it can be seen that to achieve this the random number generator 1 must first select the deck (number 68 in the example) containing the five double-diamond cards before winning the jackpot becomes possible. The chances of being dealt five double-diamond cards on the initial deal in this example are 1 in 418,710,600.

The principle of extending the number of cards from which a hand can be dealt can also be used in multi-hand card games (such as the one shown in U.S. Pat. No. 5,713,574). Two of the ways in which it can be incorporated in multi-hand games are as follows:

1. Once a deck is selected by the random number generator duplicate decks are used in all hands.
2. Separate decks are chosen by the random number generator for each hand played so that some hands may contain the special symbol and others not.
3. If the first deck selected is one including a special card then the decks selected for the other hands are one or all of the remaining decks that include one or more special cards.

In other embodiments, effectively dealing with multiple decks of cards is omitted. Instead, there is a probability of one or more special cards being dealt in a hand.

In one embodiment, the number of coins bet by the player can affect the chance of a special card being dealt. For instance, if player inserts one or more coins over the traditional maximum of 5 coins then a special card can be effectively included in the deck (typically in addition to the traditional 52 cards, although the special card may replace one of the conventional cards) from which his hand is selected. It will be understood by those skilled in the art that data representing an entire deck plus a special card need not be manipulated and this process may involve steps of selecting a combination of cards where a there is a certain probability (e.g. 1:53) of a special card being included in the combination. Inserting further additional coins (e.g. a total of 10 coins) may result in a further special card being included in the deck from which the selection is to be made, and so on.

In yet another embodiment, the number of coins inserted does not influence the probability of a special card being dealt; rather, there is a predetermined probability of a special card being selected in a combination. For example, there may be a 5% chance of one special card being selected in a combination (or being present in a "deck" from which a combination is selected), a 3% chance of two special cards and a 1% chance of three special cards. The probabilities may remain fixed throughout the game or they may vary, either randomly or they can be dependent upon game events.

I claim:

1. A method of playing a card game including steps of:

selecting a deck of cards from a plurality of decks in an at least apparently random manner, wherein some of said decks in said plurality of decks have only a plurality of conventional playing cards and others of said decks in said plurality of decks include a plurality of conventional playing cards and one or more special cards, where the special cards are either a duplicate of a conventional card or a prize-winning card whose presence in a selected combination of cards results in an award being made to the player;

selecting a combination of cards from the selected deck in an at least apparently random manner, and determining whether the combination results in a win or lose state.

2. The method according to claim 1, wherein said special card represents a duplicate of another card in the standard deck.

3. The method according to claim 1, wherein the majority of the plurality of decks are substantially conventional decks of 52 conventional playing cards, with a smaller number of the plurality of decks including at least one special card.

4. The method according to claim 1, wherein all the decks have the same number of cards, with the decks containing the one or more special cards having at least one card differentiated from a conventional card.

5. The method according to claim 1, wherein said special card includes a device that distinguishes said special card from a conventional card.

6. The method according to claim 1, further including a step of rewarding a player when said combination that results in a win state includes one or more said special cards.

7. The method according to claim 1, further including a step of making an award to a player when said combination includes a certain number of said special cards.

8. A The method according to claim 1, wherein the card game is a Poker game, with the symbols being those of conventional playing cards and each said combination being a Poker hand and the step of determining whether a combination of cards results in a win state or a lose state is made in accordance with substantially conventional Poker rules.

9. The method according to claim 1, wherein at least some of the cards in the combination are presented face-down initially to a player and the method further includes steps of:

allowing the player to turn one or more of the cards face-up, and using the card(s) that have been turned face-up as at least part of one or more further combinations of cards.

10. The method according to claim 1, wherein at least some of the cards in the combination are presented face-down initially to a player and the method further includes steps of:

allowing the player to turn one or more of the cards face-up, and using the card(s) that have been turned face-up as at least part of one or more further combinations of cards, wherein remaining card(s) in the further combination (s) are selected from the selected deck or from one or more of the other decks.

11. An amusement or gaming apparatus configured to execute steps of a method according to claim 1.

12. A method of playing a card game, comprising the steps of:

providing a plurality of decks of cards, plural ones of said decks of cards each consisting of a standard deck of conventional cards and plural ones of said decks of cards each comprising a standard deck of conventional cards and at least one additional card that is a duplicate of a conventional card;

selecting one complete deck of cards from among said plurality of decks of cards in an at least apparently random manner;

selecting a combination of cards from the selected deck of cards in an at least apparently random manner; and determining whether the selected combination of cards results in a win or lose state.

13. An amusement or gaming apparatus configured to execute the steps of the method according to claim 12.

* * * * *